US011203038B2

(12) United States Patent
Zueger

(10) Patent No.: US 11,203,038 B2
(45) Date of Patent: Dec. 21, 2021

(54) UV CURING DEVICE WITH DIVIDED UV REFLECTING MIRRORS

(71) Applicant: OERLIKON SURFACE SOLUTIONS AG, PFÄFFIKON, Pfäffikon (CH)

(72) Inventor: Othmar Zueger, Triesen (LI)

(73) Assignee: OERLIKON SURFACE SOLUTIONS AG, PFÄFFIKON, Pfäffikon (CH)

( * ) Notice: Subject to any disclaimer, the term of this patent is extended or adjusted under 35 U.S.C. 154(b) by 162 days.

(21) Appl. No.: 16/064,911

(22) PCT Filed: Dec. 7, 2016

(86) PCT No.: PCT/EP2016/002074
§ 371 (c)(1),
(2) Date: Jul. 18, 2018

(87) PCT Pub. No.: WO2017/108163
PCT Pub. Date: Jun. 29, 2017

(65) Prior Publication Data

US 2019/0001371 A1 Jan. 3, 2019

(30) Foreign Application Priority Data

Dec. 22, 2015 (DE) ..... 102015016730.8

(51) Int. Cl.
*B05D 3/06* (2006.01)

(52) U.S. Cl.
CPC ..... *B05D 3/067* (2013.01)

(58) Field of Classification Search
CPC ..... B05D 3/067
See application file for complete search history.

(56) References Cited

U.S. PATENT DOCUMENTS 4,644,899 A 2/1987 Glaus
7,323,693 B2 1/2008 Sanuki et al.
2009/0323056 A1 12/2009 Yun et al.

FOREIGN PATENT DOCUMENTS

CN 101208570 A 6/2008
CN 101334143 A 12/2008
(Continued)

OTHER PUBLICATIONS

International Search Report dated Jun. 29, 2017 in parent International application PCT/EP2016/002074.
(Continued)

*Primary Examiner* — Robert S Walters, Jr.
(74) *Attorney, Agent, or Firm* — Polson Intellectual Property Law, PC; Margaret Polson; Christopher Sylvain

(57) ABSTRACT

The present invention relates to a curing device for applying UV radiation to substrates, comprising at least one radiation source, at least one reflector member surrounding the radiation source, at least two divided dichroic mirror members opposite to the radiation source, which largely transmit the VIS & IR content of the radiation source and keep it away from the processing zone and at the same time largely reflect the UV content of the radiation source in the direction of the processing zone, at least one optical disk member that separates the cooling gas flow in the exposure device from the processing zone, and which is characterized in that the at least two divided dichroic mirror members are arranged in such a manner that they are separate from one another and offset from one another in the direction of the main beam and are displaced parallel to the main beam and thus opaque to the main beam, so that cooling gas can flow out through the openings created, but intensity loss of the UV radiation does not occur.

12 Claims, 8 Drawing Sheets

(56) References Cited

FOREIGN PATENT DOCUMENTS

| | | | |
|---|---|---|---|
| CN | 102759801 | A | 10/2012 |
| CN | 102986302 | A | 3/2013 |
| DE | 2607249 | A1 | 8/1977 |
| DE | 19651977 | C2 | 6/1998 |
| DE | 19837501 | A1 | 10/1999 |
| DE | 69707539 | T2 | 7/2002 |
| DE | 102013011066 | A1 | 1/2015 |
| EP | 0798038 | A2 | 10/1997 |
| EP | 1659333 | A2 | 5/2006 |
| JP | S6427639 | A | 1/1989 |
| JP | H09257999 | A | 10/1997 |
| JP | 2001079388 | A | 3/2001 |
| TW | 330483 | U | 4/1998 |
| WO | 2016083342 | A1 | 6/2016 |

OTHER PUBLICATIONS

Written Opinion of the International Searching Authority dated Jun. 29, 2017 in parent International application PCT/EP2016/002074.
Examination Report dated Sep. 23, 2020 in related Indian patent application 201817027271.
Office Action dated Nov. 30, 2020 in related Japanese patent application 2018533696.
Office Action dated Feb. 10, 2021 in related Chinese patent application 201680081949.6.

Figure 8

| Configuration UV deflecting mirror | UVA intensity (apex) [mW/cm²] | UVA dose rate [mJ/cm²/s] | VIS & IR dose rate [mJ/cm²/s] |
|---|---|---|---|
| flat, 1-segment (Figure 1) | 290 (74%) | 48 (83%) | 20 (74%) |
| Contiguous segments | 390 (100%) | 58 (100%) | 27 (100%) |
| Separated segments, (Figure 5) | 510 (131%) | 72 (124%) | 60 (222%) |
| Separated segments, rotation axis of component displaced (Figure 6) | 420 (108%) | 62 (107%) | 31 (115%) |
| Separated segments, with screening member 21 (Figure 7) | 500 (128%) | 69 (119%) | 32 (119%) |

UV CURING DEVICE WITH DIVIDED UV REFLECTING MIRRORS

Paint coatings serve as a protective layer of component surfaces and provide them with a specifically desired appearance. The protection of the surfaces may be of a mechanical nature, e.g. scratch resistance of the surfaces, as well as a chemical resistance or prevention of aging effects triggered by environmental influences, such as light or moisture. Paints are used particularly in the case of components made from materials whose surfaces are known to be neither mechanically very durable nor very resistant against aging phenomena under long-term exposure to ambient conditions, such as sunlight and moisture. Such materials may be various plastics or natural materials, such as wood. For the sake of comprehensibility, the following descriptions are limited to plastics without excluding other materials in the process. Both the plastic components and the paint coatings have only limited temperature resistance, which requires particular care in the process steps when processing them, in order to ensure that critical deformation temperatures are never exceeded.

UV curing paints are used in many different areas. In this case, curing is substantially understood to mean the cross-linking of polymer chains. In UV curing paints, this cross-linking is induced by UV radiation. UV curing paint coatings are advantageous, as compared to thermally induced or chemically self-curing paints, in that the curing reaction via photonic induction proceeds much faster and in a more targeted manner and depends little on diffusion processes in the paint, as is the case in thermally and chemically induced reactions. The paints are cured in a curing device, which consists of an exposure device and various peripheral components, such as the cooling device or the component conveying device, among others.

In many paints, a certain minimum dose given by the product of the radiation intensity per surface area and the exposure time (more specifically, by the time integral of the intensity) is required for complete curing. However, many common UV paints exhibit a non-linear curing behavior with respect to this surface intensity, which is why the level of curing is not solely proportional to the exposure dose but, starting from a certain threshold value, decreases disproportionately as the surface intensity becomes smaller and thus cannot be compensated any longer through the exposure time. It is thus desirable to obtain as great a surface intensity, i.e. the intensity per unit area, as possible and thus to make the required exposure time as short as possible.

High-intensity UV radiation sources are based on gas discharge lamps which, in addition to the desired UV radiation, also emit large visible light (VIS) and infrared radiation (IR) contents. VIS and IR contribute to a considerable temperature increase during the curing of paints. It must be avoided in the process, however, that the temperature rises above the glass transition temperature of the plastic components and the paint during the curing process. It is desirable to suppress this VIS & IR contribution if possible, but lose as little of the UV radiation as possible in the process. For this purpose, the use of wavelength-selective mirrors has proved to be a very efficient means for efficiently reducing the wavelength range in the VIS & IR ranges, i.e. the heat input.

For example, a device is described in U.S. Pat. No. 4,644,899 A1 which can include one or two partially transparent mirrors that increase the relative UV content of the radiation arriving at the substrate by a single or multiple beam deflection. Though the IR radiation in the curing zone is reduced by the above-described arrangement of multiple mirrors, the UV radiation dose in the zone of action is reduced, particularly in the case of multiple deflections. Furthermore, the inventors have recognized that a heat dissipation issue arises in the exposure device due to the heat produced by the transmitted IR radiation if a compact overall design is intended. Air or liquid-cooled cooling fins disposed behind the partially transparent mirror in the direction of the main beam of the UV source are mentioned as a solution. However, this cooling strategy has considerable drawbacks at first sight. On the one hand, only an indirect cooling of the exposure apparatus is effected, but not of the mirror or the radiation source. On the other hand, a cooling device has to be mounted behind the partially transparent mirror, which has an influence on the size of the device and on possible maintenance work in the exposure device.

DE 69707539 T2 proposes to use segmented UV deflecting mirrors for separating the UV content from the VIS & IR content of the UV source in order to redirect the UV light into the curing zone. Here, the individual deflecting mirror segments are presumed to abut against each other without spacing, and the cooling of the UV source and of the deflecting mirrors is carried out by means of a cooling gas stream which is conveyed away at the end of the contiguous deflecting mirror farthest away from the UV source. In this case, the cold-light reflector assembly according to the embodiment includes a plate-shaped heat refraction filter, which spatially shields the lighting unit from the curing zone and thus prevents the heated gas from flowing out opposite from the substrate. However, this curing device has the crucial drawback that a certain device size is required for a sufficient cooling by means of the gas flow, which causes an extended light path of the UV radiation to the component, which has to be accompanied with a reduction of the surface intensity.

Accordingly, the prior art yields some requirements for an economically viable and efficient curing device which could not be realized to a sufficient extent so far. Among others, they are:

- As great a UV surface intensity as possible is to be obtained in the curing zone.
- An unwanted thermal load on the substrates due to the VIS and IR content of the radiation is to be avoided.
- A practical implementation of the curing device is supposed to be as simple as possible, and thus simple to maintain and cost-effective to realize.
- The curing device is supposed to take up as small a geometric size as possible and be easily adaptable to different substrate geometries.
- Cooling the curing device, and in particular the exposure device, should be possible with little effort; the option of a separate cooling of the substrate would be desirable.

According to the invention, a UV curing device with divided UV deflecting mirrors is used which significantly shortens the light path from the UV source to the substrate and thus enables a crucial increase of the surface intensity in the application zone as well as ensures an efficient cooling of the heat-exposed components of the device at the same time. Thus, a simple design of the curing device, optimum exposure conditions for a high-intensity UV application to the substrates, and the shortening of the exposure times made possible thereby can be obtained, which accommodate the economic aspect of the invention. Furthermore, it becomes possible to cool the substrates separately by means of cooling gas or air and to preclude a thermal overload of the substrate in the case of an elevated UV dose.

The invention is explained in detail below and supplemented by way of example with Figures:

FIG. 1 schematically shows a UV curing device in a lateral sectional view with a planar deflecting mirror 8 for separating UV light from VIS & IR light. As a schematic representation of the optical path, only three beams from the UV source are shown in a simplified manner, wherein the center beam is supposed to correspond to the main beam.

FIG. 2 schematically shows the curing device according to FIG. 1 in a top view, with a length L that may be substantially arbitrary. In this case, the lateral reflectors 18, with which the illumination in the processing zone is made more uniform over the length of the source, are shown to adjoin the ends of the deflecting mirror 8.

FIG. 3 schematically shows a typical intensity distribution of the UV radiation over the length of the irradiation device in the processing zone, in which components for exposure are located, with, 182, and without, 181, lateral reflector members 18.

FIG. 4 schematically shows a UV curing device in a lateral sectional view with individual segmented deflecting mirror members offset relative to one another, between which the heated cooling gas can flow away from the UV source in a direction upwards. This arrangement enables a reduction of the light path d between the UV source and components while at the same time maintaining the required cooling gas flow of the UV source.

FIG. 5 schematically shows a UV curing device in a lateral sectional view with individual segmented deflecting mirrors offset relative to one another, which are disposed at different angles to the main beam in order to focus the UV radiation in the processing zone and collect the UV radiation of the source more efficiently.

Table 1 shows UVA intensity, UVA dose rate, and VIS & IR dose rate data for different mirror configurations.

FIG. 8 is a table showing UVA intensity, UVA dose rate and the corresponding dose rates for the incident VIS & IS light for different mirror configurations.

Figure 1:
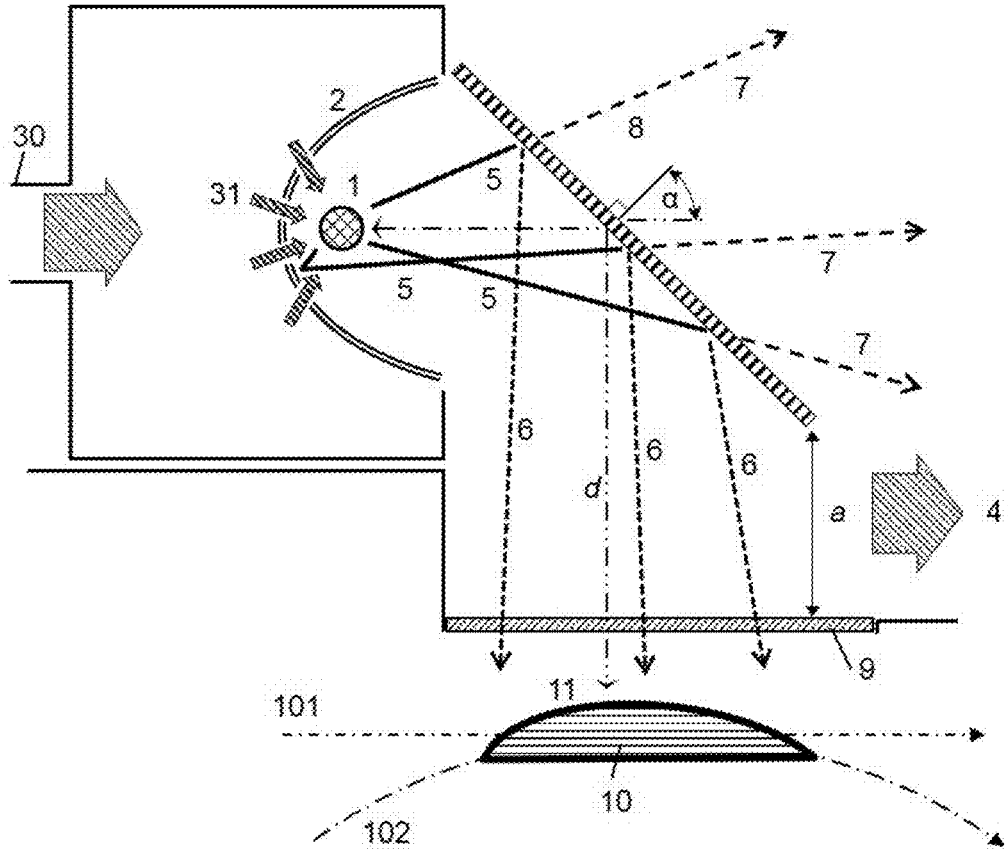

A typical configuration of a UV curing device is depicted in FIG. 1. High-intensity wide-band UV radiation sources consists of a gas discharge lamp 1 and a lamp reflector member 2, which collects UV radiation emitted in the direction facing away from the component and reflects it in the direction of the region in which the components 10 coated with UV curing paint 11 are located. Therefore, a radiation composed of direct radiation and reflected radiation is applied to this region, which is hereinafter referred to as the processing zone. In the case of a substantially linear source, the gas discharge lamp 1 is substantially tubular. However, it may also consist of one, or a series of individual, substantially point-shaped lamps arranged in a row. Gas discharge lamps as UV radiation sources consist of a hermetically sealed tube 1, which is highly transparent to UV radiation, with an amount of metal enclosed in it that can be evaporated, and an inert gas filling. The latter is excited by an electrically induced gas discharge, whereby it is heated and leads to an evaporation of the amount of metal by heat transfer. As a consequence, the metal vapor formed is also electrically excited, and the metal vapor plasma forming in the process emits radiation in accordance with known excitation lines, in particular UV light. In addition to the desired emission of UV light, the plasma also emits radiation in the visible (VIS) and infrared (IR) range of the electromagnetic spectrum. A part of the infrared radiation emitted by the metal vapor plasma is absorbed in the tube of the gas discharge lamp, which usually consists of a UV-transparent quartz glass, and results in the tube heating up. The hot gas in the tube also transfers heat to the tube walls. Since the quartz glass material of the tube, due to its material properties, has limits with respect to temperature, the exceedance of which results in the loss of strength of the tube, this tube needs to be cooled. In the technically relevant case of application, cooling takes place by means of an incoming flow of gas 31 (usually air), which heats up and thus conveys the energy away from the tube. The feed of cooling gas is usually effected actively, with pressure, in order to increase the flow rate and thus the cooling performance, via one or more inlet openings 30.

In order to bring as much emitted UV light as possible into the processing zone, the lamp tube is partially surrounded on one side by a lamp reflector member 2, which efficiently reflects the UV radiation into the opposite side into the processing zone. The feed of the cooling gas 31 substantially needs to take place on the side of the lamp reflector, because at the front, the desired UV radiation is supposed to be able to propagate unimpeded to the component to be exposed. Specifically, the gas stream may be fed through holes in the lamp reflector member 2, through which the gas flows towards the lamp tube 1 with pressure. The heated gas needs to be able to flow away as unimpeded as possible on the processing zone side, in order to be able to ensure cooling effectivity.

In order to reduce the VIS & IR content of the emitted radiation of the lamp incident into the processing zone, the lamp reflector member 2 may be provided with a coating which reflects the UV content of the radiation well, but reflects little of the VIS & IR content. This may be effected with a dichroic thin-film coating which, on the one hand, is highly reflective for the UV content and transmits the VIS & IR contents into the lamp reflector body, which are absorbed by the reflector material underneath. In the process, the lamp reflector is heated up, and the resulting heat has to be dissipated via the IR radiation and the gas flow.

The direct radiation from the tubular gas discharge lamp, i.e. the radiation that does not arrive in the processing zone via lamp reflectors, undergoes no reduction of the VIS and/or IR content. In addition, a residual portion of the VIS & IR radiation that is not transmitted by the coating of the lamp reflector and is not absorbed in the reflector comes into the processing zone.

A further suppression of the VIS & IR radiation can be achieved by an additional wavelength-selective deflecting mirror 8 positioned in the optical path. This deflecting mirror 8 is supposed to reflect the UV content in the radiation 5 from the source as well as possible but, in contrast, reflect the VIS & IR content 7 as poorly as possible. In the simplest case, such a deflecting mirror is configured as a flat mirror covered with a dichroic thin-film filter coating. This mirror is usually disposed at an angle of 45° between the normal of the mirror surface and the main beam of the UV source, wherein the processing zone with the components 10, to which the UV curable paint 11 has been applied, is located downstream in the optical path of the UV radiation reflected by the deflecting mirror, rotated by 90° relative to the main beam of the UV source. The deflecting mirror may also be disposed at an angle α relative to the mirror normal that deviates from 45°, wherein the processing zone is then arranged so as to be rotated by the angle 2·α relative to the main beam of the UV source.

The majority of the VIS & IR radiation 7 is transmitted by the specific selection of the dichroic filter coating. In order to prevent the deflecting mirror from heating up excessively, which would occur due to absorption of this VIS & IR radiation in the deflecting mirror substrate and which, in turn, would cast IR radiation into the processing zone, a suitable VIS & IR transparent mirror substrate material is selected for the deflecting mirror, and it is ensured that the VIS & IR radiation 7 is further transmitted through the mirror, if possible, and thus kept away from the processing zone. Glasses with a high VSI & IR transparency are particularly suitable as a mirror substrate. Borosilicate glass or quartz glass are particularly suitable for this purpose, but the transparency also for these glasses in the IR range is limited to wavelengths of less than 2800 nm and 3500 nm, respectively. With respect to the transmitted VIS & IR radiation 7, it has to be ensured that, in the rest of the structure, it is deflected and finally absorbed in such a way that it can neither reach the processing zone nor the UV source itself in any considerable amount via multiple reflections on parts of the structure, in order to avoid undesired heating-up in both cases.

The dimensions of the deflecting mirror 8 are to be selected in such a way that as large a portion of the light emitted by the source is incident upon the mirror and directed into the processing zone. Together with the size of this UV deflecting mirror, however, the light path d between the UV source and the processing zone increases, whereby the UV light intensity in this zone decreases. Furthermore, the cooling gas stream must be conveyed away from the UV source past the deflecting mirror. The flow of this cooling gas should be as laminar as possible in order to ensure an efficient and almost unimpeded outgoing flow.

Usually, as can be gathered from the prior art and is shown in FIG. 1, the cooling gas stream runs along a closed line and flows out through an opening with the width a at the end of the UV deflecting mirror farthest away from the UV source.

Figure 4:
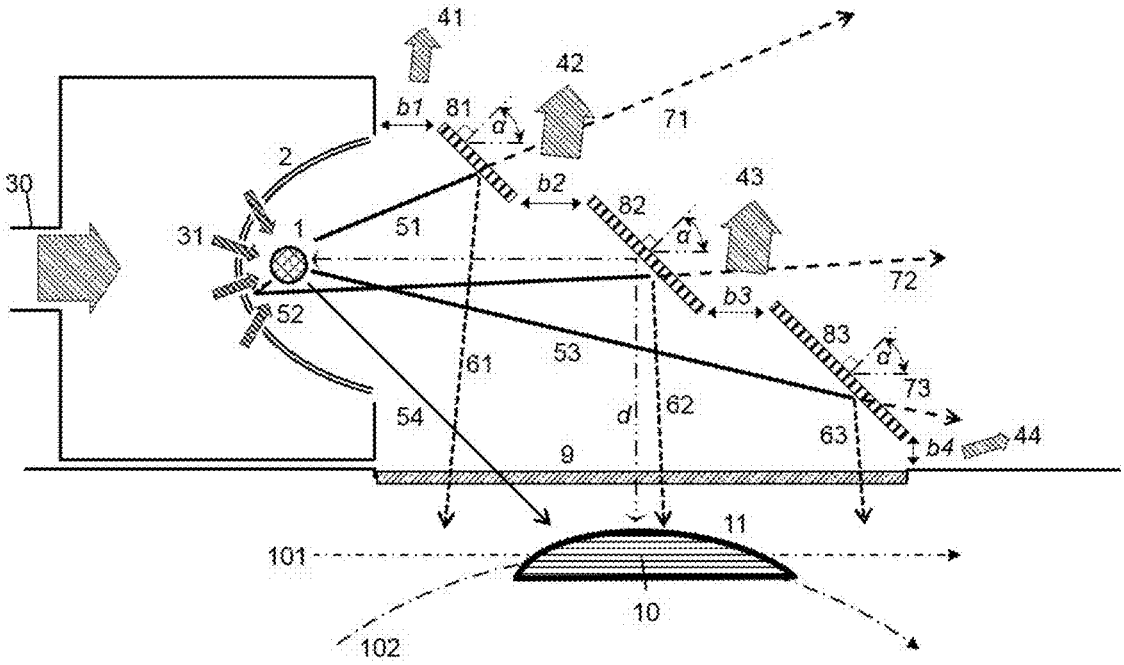

Unexpectedly, however, the cooling gas may also flow via several openings along an imaginary line from the end of the lamp reflector 2 to the end of the divided UV deflecting mirrors 81 to 83 in FIG. 4. As is apparent from FIG. 4, minimal openings with the cross-sectional widths b1 to b4 between the divided UV deflecting mirrors and the deflecting mirrors and the reflector member 2 or the disk member 9 are sufficient for the cooling gas stream to be able to separate into the areas 41 to 44. It is thus possible to bring up the disk member 9 closer to the divided mirror members, which causes the entire light path d from the UV source to the surface of the coated substrate to be shortened.

In order for the heated cooling gas stream of the lamp tube and of the lamp reflector not to flow directly into the processing zone and result in an unwanted heating-up of the components to be exposed, the gas stream is separated from the processing zone using an optical disk member 9 which transmits the desired UV radiation as well as possible. In the simplest configuration, a disk member made of quartz glass is used for this purpose.

Furthermore, due to the above-described spatial separation of the processing zone from the exposure device by means of an optical disk member 9, it is possible to cool the substrate separately by means of cooling gas, which permits the admissible exposure dose to be increased.

Figure 2:
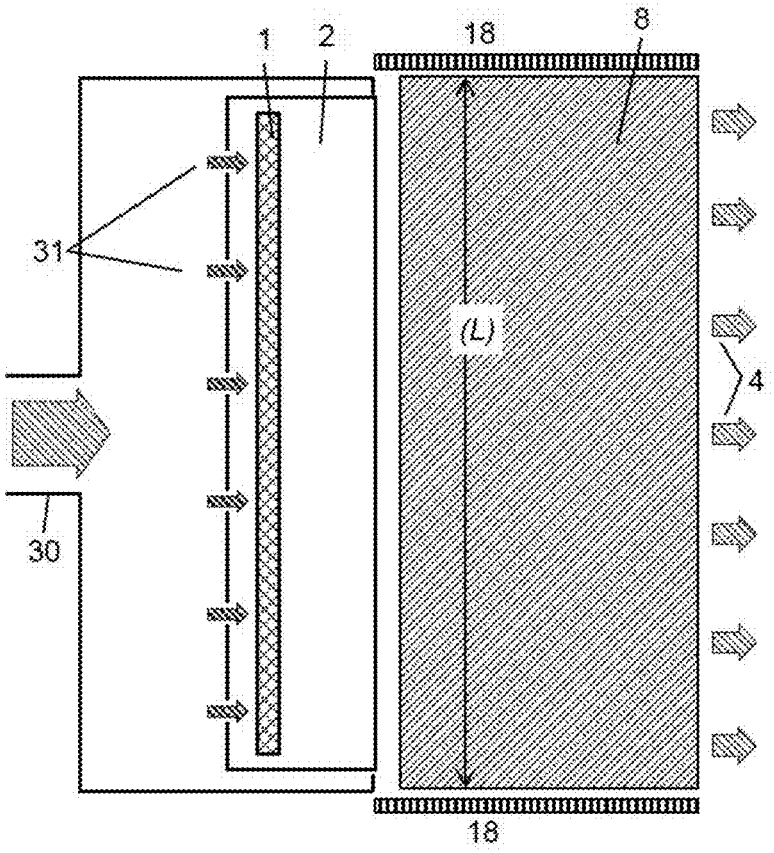

Though the necessary cooling gas stream at a reduced cross-sectional widths a la could be achieved with active extraction devices in the averted region of the deflecting mirror, however, this requires additional pumps and arrangements of the mirrors and their holders that are advantageous to the flow, in order to ensure a uniform extraction flow over the length L of the mirror. The length L of the mirror designates the dimension perpendicular to the plane of FIG. 1 and is shown as a top view onto the assembly in FIG. 2. Such flow-optimized assemblies, however, constitute an unwanted limitation with respect to a UV light guidance into the processing zone that is as efficient as possible.

At least in the case of a limited length of the UV source and the deflecting mirror, the cooling gas flow could be conveyed away laterally, i.e. perpendicularly to the plane of FIG. 1. As the length L of the source increases, however, an ever larger cooling gas flow would have to be conveyed away via these two lateral openings, which sets limits on the cooling efficiency as the length L increases, particularly in the area of the center of the UV source.

In order to obtain a high degree of uniformity of illumination over the length L of the UV source, preferably, flat reflector members 18 are attached to the deflecting mirror in a laterally abutting manner. These lateral reflector members direct light beams of the UV source, which have a major component laterally along the length L of the UV source and mainly propagate in these directions, into the processing zone which substantially extends over the length L of the UV source. A better uniformity of illumination of the processing zone with UV light is achieved with these lateral reflectors 18.

Figure 3:
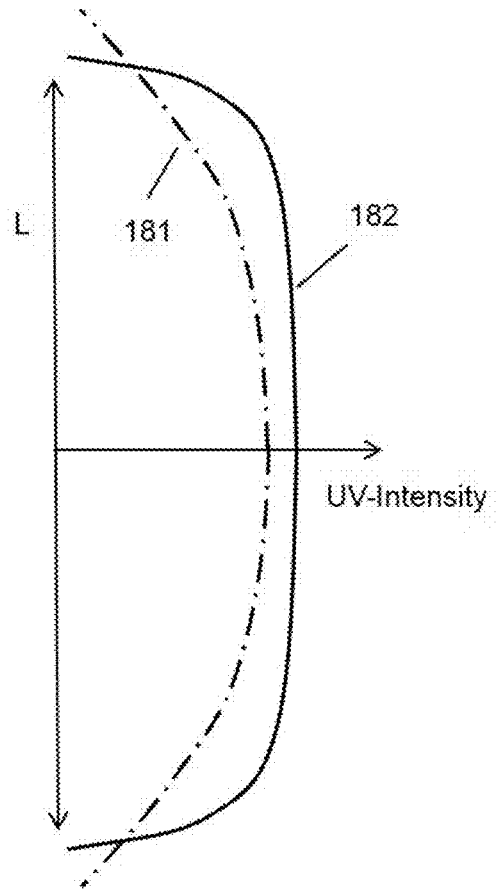

FIG. 3 schematically shows intensity distribution curves over the length L of the UV source. Curve 181 shows the case without lateral reflector members 18; curve 182 shows the case with lateral reflector members 18, with the improved illumination as compared to curve 181.

These lateral reflector members 18 substantially extend over the entire height from the upper edge of the deflecting mirror 8 to the disk member 9 in FIGS. 1 and 4 to 7, in order to obtain as homogeneous an illumination as possible over the length L. With the preferable use of these lateral reflector members 18, however, the cooling gas is hindered from being able to drain off laterally. Therefore, in this configuration, which is advantageous for the illumination of the processing zone, it must be ensured that the cooling gas stream is able to flow out exclusively via the cross-sectional opening width a into the region 4.

A preferred embodiment of the invention of the subject matter is schematically shown in FIG. 4 with a solution for directing the UV light into the processing zone as efficiently as possible while simultaneously efficiently conveying away the cooling gas flow from the UV source. By dividing the deflecting mirror into individual separated segments offset from one another in the direction of the main beam, the cooling gas can be divided into individual cooling gas flow segments 41, 42, 43, 44 between the mirror segments. The division into three mirror segments shown in FIG. 4 is to be understood as an example; divisions into more than two, i.e. N, segments are possible, wherein N can be an integer greater than or equal to two. In order to be able to ensure at least the same cooling efficiency as in the above-described embodiment, with only one or two openings, the sum of the openings widths b1, b2, b3, b4 in FIG. 4 has to be substantially equal to the width a in FIG. 1. This requirement yields the same cross-sectional surfaces for the exit of the cooling gas flow, and thus substantially the same cooling performance for different configurations. It has proved to be particularly advantageous if both the widths b1 and b4 are kept as small as possible in order to configure the light path d between the source and the processing zone to be as short as possible. In order to obtain the necessary cooling gas stream, this yields the gap widths b2 and b3 for the offset of the deflecting mirror segments. In particular by minimizing b4, both the optical disk member 9 and, accordingly, the paint-coated components 10 can be brought up considerably closer to the deflecting mirrors. Thus, the light path d between the UV source and components is shortened, which results in an advantageously higher intensity of the UV light incident upon these components. As a consequence, the exposure time for curing the paint can be shortened with a constant UV dose (=UV intensity multiplied by the exposure time), whereby a higher level of productivity in the exposure process is achieved in this assembly.

However, the reduction of the distance b1 of the mirror segment 81 from the UV source has natural limits. If the distance is too small, a part of the UV light reflected on the mirror segment 81 is turned back into the UV source and does not arrive in the processing zone as desired.

Figure 5:
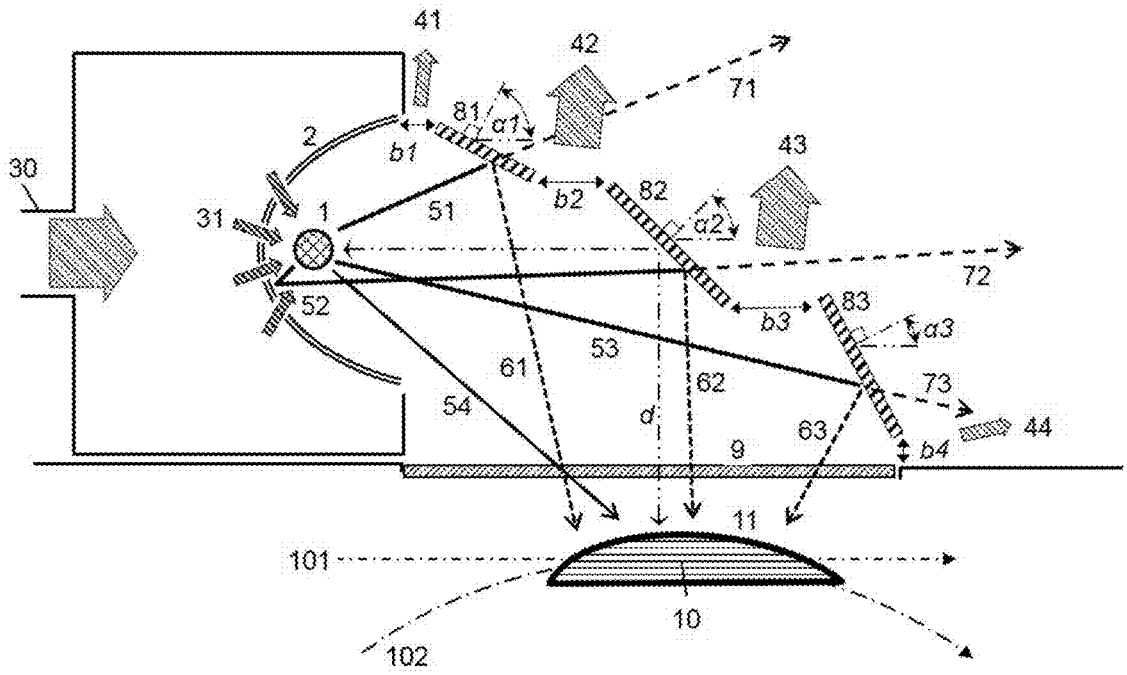

A particularly preferred embodiment is shown in FIG. 5, wherein the tilt angles $\alpha$1, $\alpha$2, $\alpha$3 of the individual deflecting mirror segments 81, 82, 83 can be different from one another. Accordingly, these angles may be individually adapted to the situation. For example, by enlarging the tilt angle $\alpha$1 of the segment 81 to a value greater than $\alpha$2 of segment 82, which corresponds to the angle $\alpha$ in FIG. 1, the reflected UV light 61 can be directed into the processing zone with a higher efficiency by the segment 81. Equally, for example, the angle $\alpha$3 of segment 83 may be made smaller in order to bring the reflected UV light 63 closer into the region of the UV light 62 of segment 82. Not only can the UV light be collected more efficiently by adapting these angles $\alpha$1, $\alpha$2, $\alpha$3, it can also be brought into a region with a smaller geometrical extent, whereby the existing intensity in this region if further increased, which, due to the above-mentioned intensity dependency of the curing dose of the paint, is advantageous. This collecting of the UV light in a region of a smaller extent corresponds to focusing the UV light in the processing zone.

In the case of the components moving on a circular trajectory 102, as indicated in FIGS. 1 and 4 to 7, the geometric extent of the usable processing zone is scaled by the radius of the circular trajectory of movement. Given a design that is advantageous as regards machine technology, this trajectory should not be kept larger than minimally necessary for the respective component size. Using the suitable tilts $\alpha$1 to $\alpha$N of the individual deflecting mirror segments relative to the main beam provides the advantage that an exposure system can thus be built in a geometrically smaller and thus more cost-effective manner.

Furthermore, it is possible, in the case of a high UV intensity, to keep the temperature of the paint-coated components under their critical application range, because the invention of the subject matter makes it possible, during curing, to pass the components 10 very close to the processing zone in a single movement or also in an alternating movement back and forth, linearly 101, or rotating 102 on a circular trajectory.

In the embodiments so far, it was assumed that the deflecting mirrors are configured in three segments. According to the invention, the deflecting mirror may be divided in at least two to N segments, wherein N is supposed to represent an integer.

The invention is to be explained based on a specific example below. A FusionUV-Heraeus Type LH10 source equipped with a H13 plus mercury metal halide gas discharge lamp is to be used as a UV radiation source. This source has a length L of about 25 cm. The total radiation power is nominally 6 kW and requires a cooling gas stream of minimally 150 L/s ambient air, which has to be supplied to the UV source via the connection provided for this purpose with about 2500 Pa overpressure. In accordance with the situation in FIG. 1, this cooling gas stream is conveyed away past the UV deflecting mirror in a laminar flow. It is achieved by the cross-sectional opening width being dimensioned with a=80 mm, which results in a outgoing flow speed of the cooling gas of about 7 m/s, whereby a substantially still laminar flow or slightly turbulent flow about the cross-sectional widths can be obtained.

The components are cyclically guided into the processing zone on a circular trajectory with a diameter of 220 mm, wherein they are located at a distance of 20 mm from the disk member 9 at the apex of the rotary movement. With a single deflecting mirror, these conditions result in an intensity for the UVA radiation (average over the wavelength range 320 . . . 400 nm) at the apex of the circular trajectory of 290 mW/cm$^2$ and a UVA dose rate of 48 mJ/cm$^2$/s, wherein the dose rate refers to the dose that a flat component surface element receives during one rotation on the circular trajectory at a rotation speed of 1 rotation per second. If the work is carried out with a similar configuration, but with contiguous, segmented deflecting mirrors in accordance with the above-described prior art, in which the cross-sectional opening width is kept constant at a=80 mm, a UVA intensity at the apes of 390 mW/cm$^2$ and a UVA dose rate for the rotary movement of the components of 58 mJ/cm/s can be achieved. The length of the light path d of the main beam, from the gas discharge lamp to the apex of the rotary movement of the components, rounded off, amounts to d=285 mm in both cases, given a total width of the deflecting mirror of 175 mm.

In the configuration according to the invention corresponding to FIG. 5, the distances are chosen to be b1=5 mm, b2=30 mm, b3=40 mm and b4=5 mm, so that the sum b1+b2+b3+b4=80 mm, as in the above cases with a=80 mm. Thus, the light path d of the main beam is decreased from 285 mm to 250 mm, i.e. the light path is shortened by 35 mm. According to the invention, the angles of the deflecting mirrors are adapted in the process in such a way that a maximum UV light intensity in the processing zone is achieved. In the present example $\alpha$1=60°, $\alpha$2=45° and $\alpha$3=25° are selected. With this assembly, a UVA intensity of around 510 mW/cm$^2$ and a dose rate for the cyclic rotary movement of the components of 72 mJ/cm$^2$/s is obtained at the apex, i.e. an increase of the intensity by around 30% and of the dose rate of 24%, compared with the case of the segmented, but contiguous deflecting mirror. These improvements are solely achieved, in particular, by dividing and orientating the deflecting mirror segments, while the power of the UV source remains constant.

With the light path shortened in this configuration, light beams can now be incident onto the components to be exposed in the processing zone on a direct path from the UV lamp. Since no suppression of the VIS & IR radiation takes place in the case of these light beams, they result in the components heating up to a greater extent. The incident dose rate of VIS & IR radiation on the components per rotation cycle is 60 mJ/cm$^2$/s in the case shown, whereas this value is only 27 mJ/cm$^2$/s for the case corresponding to the prior art, with contiguous, segmented deflecting mirrors. The VIS & IR light increases to more than twice this amount in this configuration with the smaller light path and partially direct VIS & IR irradiation, while the desired UV radiation rises by 24% as regards the dose rate.

Figure 6:
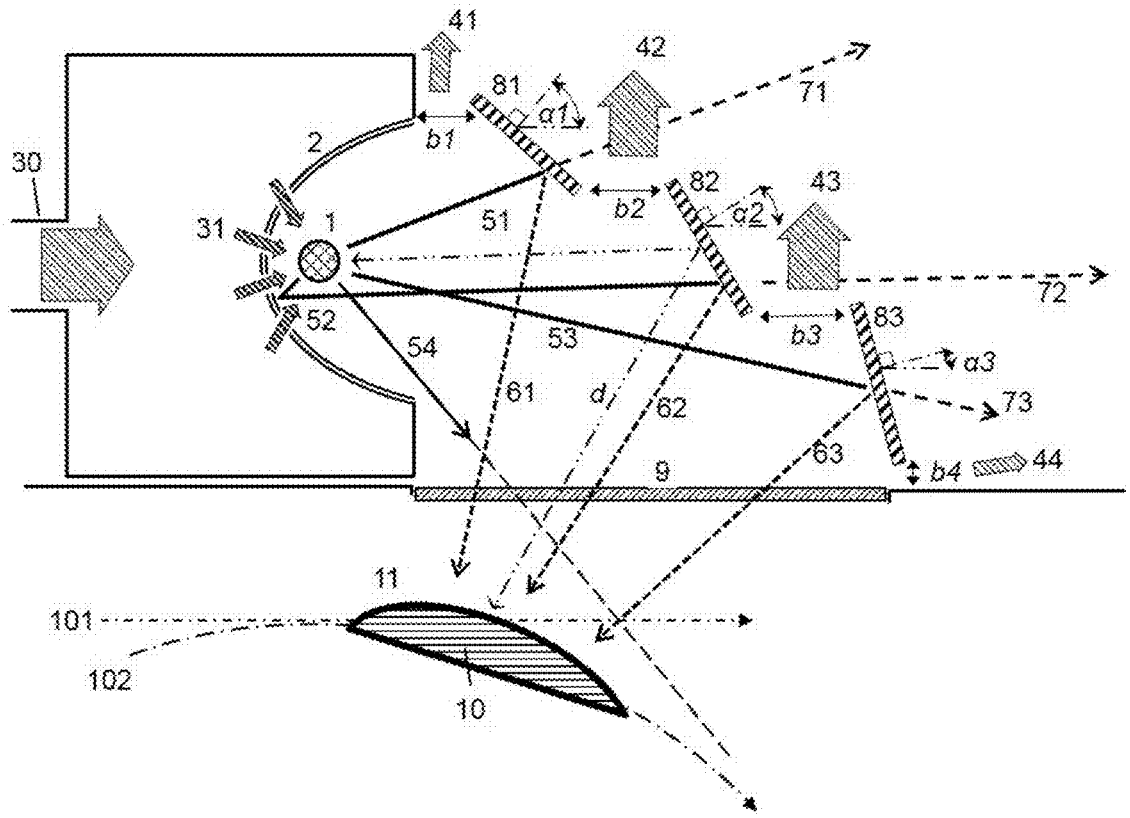
FIG. 6 shows a UV curing device in a lateral sectional view corresponding to FIG. 5, wherein the arrangement of the components is displaced or inclined relative to the UV source in order to minimize the direct irradiation of components by VIS & IR light from the UV lamp.

Another embodiment is shown in FIG. 6. Compared to FIG. 4 or FIG. 5, the axis of rotation of the movement of components is displaced, relative to the UV source, in such a way that no light beams are able to arrive at the components directly from the UV lamp any longer. At the same time, the UV deflecting mirrors are disposed at an angle <45° relative to the main beam, whereby a UVA dose rate in the present case of around 62 mJ/cm$^2$/s is achieved at 31 mJ/cm$^2$/s for the VIS & IR dose rate, which is approximately the same as in the case of the segmented and contiguous mirror. Thus, an increase of the UV dose rate is achieved, compared to the prior art with the contiguous segmented UV deflecting mirrors, which, however, is less than the UVA dose rate as in the case of the separated UV deflecting mirrors as shown in FIG. 5.

As an alternative, instead of positioning the axis of rotation of the substrates closer to the UV source, the UV source may be inclined in such a way that it is inclined away from the substrates 10 and thus, the housing of the UV source shields the direct radiation of the UV source towards the substrate and, accordingly, the substrates are exposed only to the reflected radiation from the reflector member 2 and/or the divided mirror members.

Figure 7:
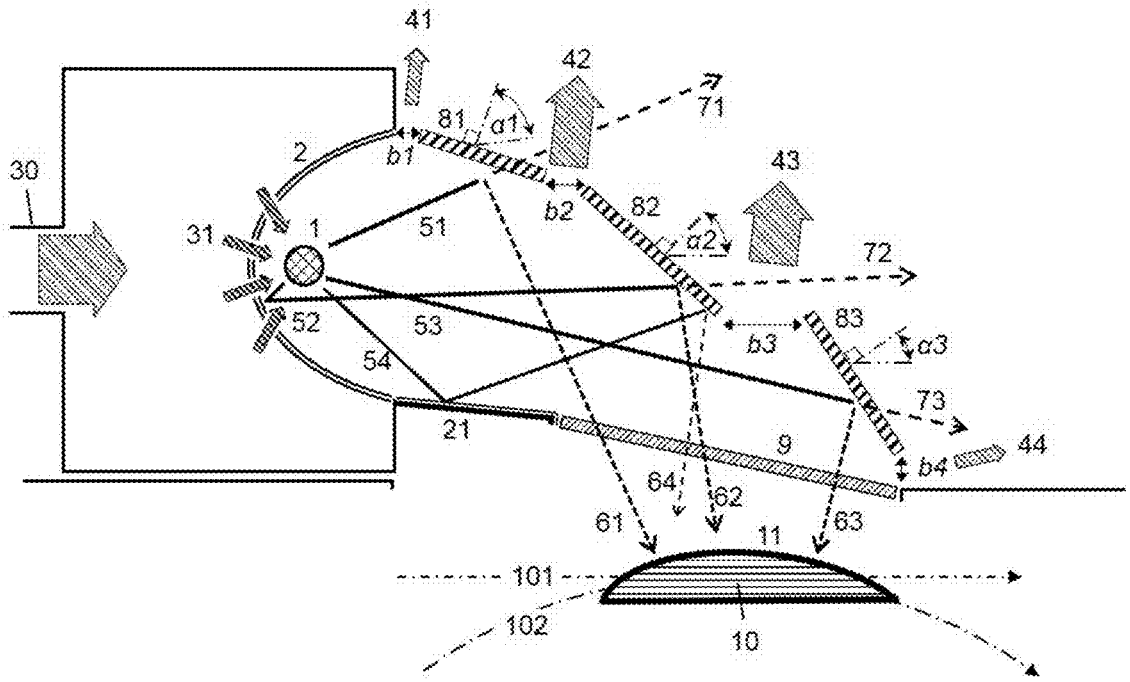
FIG. 7 shows a UV curing device in a lateral sectional view, as in FIG. 5, with an additional screen 21 preventing an irradiation of the substrate with direct radiation from the UV source.

Another example of an application is illustrated by means of FIG. 7. If, in accordance with the configuration from FIG. 5, a screening member 21 with a length of 25 mm is inserted at the lower end of the reflector member 2, which blocks all direct beams from the UV lamp to the components in the processing zone, the thermal load due to directly incident VIS & IR light can be eliminated. Just like the reflector member 2, the screening member 21 may be coated in order to increase UV reflection, however, the screening member is absolutely required to be opaque to the VIS & IR radiation. The inadvertent blocking with this screening member of UV light which, reflected by the UV deflecting mirror segment, was supposed to fall into the processing zone, is comparatively small. At a UVA dose rate of 69 mJ/cm$^2$/s, it drops by only about 3% as compared to the assembly in FIG. 5, whereas the VIS & IR content, at 32 mJ/cm$^2$/s, is reduced almost to the value that also results in the prior art with the contiguous segmented UV deflecting mirrors, of 27 mJ/cm$^2$/s. In the present case, in the configuration depicted in FIG. 7, an increase of the UVA dose rate of about 19% can thus be achieved, wherein the relative content of VIS & IR light to the UV light remains the same as in the case of the contiguous segmented UV deflecting mirrors. The indicated data of UVA intensity, UVA dose rate and the corresponding dose rates for the incident VIS & IS light for the cases of FIGS. 1, 5, 6 and 7 shown here are summarized in the table of FIG. 8. The case of the contiguous segmented UV deflecting mirror corresponding to the prior art was taken as the 100% reference value for the comparisons of the UVA intensity and dose rate.

A linear movement of components through the processing zone is possible in all embodiments mentioned above, wherein the components are slightly exposed to the direct irradiation from the UV lamp in the configurations of FIGS. 5, 6 and 7. In the case of real application, a complete suppression is often unnecessary, and from an economic standpoint, this effect can be easily compensated by the improved UV dose rate as well as the possibility of an additional cooling of the substrate due to the arrangement in space and thus, shorter exposure cycles.

In addition to the reduction of the light path d and the surface intensity on the components increased thereby, an optimum outgoing flow of the cooling gas is achieved by the curing device according to the invention with the separately disposed mirror segments. The optimization of cooling of the exposure device inherent to the invention further permits a hitherto impossible increase of the power of the UV source, without risking a negative influence on the paint-coated substrates, which corresponds to an overall increase of efficiency of the UV intensity in the curing zone.

Seen from the side, i.e. parallel to the main beam, the individual mirror members separated from one another may be offset from one another in such a way that the upper edge of a mirror member protrudes over the lower edge of the adjacent mirror member, which, see from the UV source, is perceived as an "opaque" and thus continuous mirror surface, whereby a loss of intensity of the UV radiation is avoided. A curing device was proposed for components (10) coated with a curable paint (11), comprising at least one radiation source (1), at least one reflector member (2) surrounding the radiation source, at least two divided dichroic mirror members opposite to the radiation source, which largely transmit the VIS & IR content of the radiation source and keep it away from a processing zone and at the same time reflect the UV content of the radiation source in the direction of a processing zone, at least one optical disk member (9) that separates the cooling gas flow in the exposure device from the processing zone, characterized in that the at least two divided dichroic mirror members are arranged in such a manner that they are separate from one another and offset from one another in the direction of the main beam and are displaced parallel to the main beam and thus opaque to the main beam, so that cooling gas can flow out through the openings created, but intensity loss of the UV radiation does not occur.

In a preferred embodiment, the at least two divided dichroic mirror members are inclined relative to one another by respective angles $\alpha$1 to $\alpha$N between the mirror normal and the main beam direction of the UV source in such a way that the UV radiation is combined in the processing zone.

In a preferred embodiment, the angles $\alpha$1 to $\alpha$N of the deflecting mirror members are different from one another in such a way that the largest angle $\alpha$1 is assumed by the mirror member closest to the reflector member (2), and the angles of the other mirror members are smaller than $\alpha$1, wherein the angle of the mirror segment closest to the mirror member (9) is $\alpha$N and constitutes the smallest of the angles $\alpha$1 to $\alpha$N.

In a preferred embodiment of the curing device, reflector members (18) are laterally attached to the lighting device over the entire height from the upper edge of the at least two mirror members to the disk member (9).

In a preferred embodiment, the UV source and the at least two divided dichroic mirror members are arranged in such a manner that both direct radiation and reflected radiation are directed into the processing zone.

In a preferred embodiment, only reflected radiation is directed into the processing zone.

In a preferred embodiment, the UV source is inclined in such a way that no direct radiation is incident into the processing zone.

In a preferred embodiment, of all openings with the cross-sectional widths (b1) to (bN) that are located between the individual mirror members, as well as between the mirror member arranged closest to the reflector member and the reflector member (2), as well as between the mirror member arranged closest to the disk member (9) and the disk member (9), the opening between the mirror member (9) and the closest mirror member takes up the smallest cross-sectional width, bN.

Furthermore, a method for curing paint-covered substrates was presented, which uses a curing device in which the cooling gas is conveyed away via openings between the mirror members as described above, and in which the UV intensity in the processing zone is increased by shortening the light path d from the source to the surface of the coated substrate by means of a suitable number and arrangement of the mirror members with respect to distance, angle and the like. In a preferred embodiment, in addition to cooling the exposure device, the painted components are separately cooled by means of cooling gas.

| | |
|---|---|
| Gas discharge lamp: | 1 |
| Lamp reflector: | 2 |
| Cooling gas feed: | 30 |
| Cooling gas feed stream: | 31 |
| Cooling gas discharge stream/streams: | 4, 41, 42, 43, 44 |
| Emitted radiation of UV source: | 5, 51, 52, 53, 54 |
| Radiation reflected by UV deflecting mirror (predominantly UV): | 6, 61, 62, 63 |
| Radiation transmitted by UV deflecting mirror (primarily VIS&IR): | 7, 71, 72, 73 |
| Deflecting mirror, deflecting mirror segments: | 8, 81, 82, 83 |
| Optical disk member for dividing cooling gas stream: | 9 |
| Components: | 10 |
| Paint coating of components: | 11 |
| Linear movement of components: | 101 |
| Rotating movement of components: | 102 |
| Screen | 21 |
| Lateral reflector member | 18 |
| UV intensity distribution without lateral reflector members | 181 |
| UV intensity distribution with lateral reflector members | 182 |
| Cross-sectional width of openings, in each case: | |
| between disk member 9 and deflecting mirror 8: | a |
| between reflector member 2 and mirror segment 81: | b1 |
| between mirror segments 81-82 and 82-83: | b2, b3 |
| between disk member 9 and mirror segment 83: | b4 |
| Angle of surface normal of deflecting mirror 8 relative to main beam axis of UV source: | α |
| Angle of surface normal of deflecting mirror segments 81, 82, 83 relative to main beam axis of UV source: | α1, α2, α3 |
| Length of exposure device: | L |
| Light path of main beam from UV source to surface of component 10: | |

The invention claimed is:

1. A curing device for components coated with a curable paint, comprising at least one radiation source, a curved reflector member surrounding the radiation source, at least two divided dichroic mirror members opposite to the radiation source, which transmit VIS & IR content of the radiation source and keep the VIS & IR content away from a processing zone and at the same time reflect UV content of the radiation source in a direction of the processing zone, and at least one optical disk member that separates the processing zone from a cooling gas flow conveyed to the radiation source, characterized in that the at least two dichroic mirror members are arranged in such a manner:

that the mirror members are separate from one another and offset from one another in a direction extending from the radiation source parallel to the perpendicular to the tangent of the curve at the center point of the curved reflector member where the curvature is maximum, such that openings are formed between the mirror members, and the mirror members are also displaced from one another at different positions parallel to the direction extending from the radiation source, and thus opaque with respect to UV radiation emitted in said direction in together providing a continuous mirror profile, so that cooling gas can flow out through the openings, but intensity loss of the UV radiation does not occur.

2. The curing device according to claim 1, characterized in that the at least two divided dichroic mirror members are inclined relative to one another by respective angles α1 to αN between the mirror normal and the direction extending from the radiation source in such a way that the UV radiation is combined in the processing zone, and wherein N is the total number of divided dichroic mirror members.

3. The curing device according to claim 2, characterized in that the angles α1 to αN of the mirror members are different from one another in such a way that the largest angle α1 is assumed by the mirror member closest to the curved reflector member, and the angles of the other mirror members are smaller than α1, wherein the angle of the mirror member closest to the optical disk member is αN and constitutes the smallest of the angles α1 to αN.

4. The curing device according to claim 1, characterized in that the curved reflector member is laterally attached to a lighting device over the entire height from the upper edge of the at least two mirror members to the optical disk member.

5. The curing device according to claim 1, characterized in that the arrangement of the radiation source and the at least two divided dichroic mirror members directs both direct radiation and reflected radiation into the processing zone.

6. The curing device according to claim 1, characterized in that only reflected radiation is directed into the processing zone.

7. The curing device according to claim 1, characterized in that the radiation source is inclined in such a way that no direct radiation is incident into the processing zone.

8. The curing device according to claim 1, characterized in that, of all openings with cross-sectional widths b1 to bN, with N being the total number of all the openings, that are located between the individual mirror members, as well as between the mirror member arranged closest to the curved reflector member and the curved reflector member, as well as between the mirror member arranged closest to the optical disk member and the optical disk member, the smallest cross-sectional width, bN, is between the optical disk member and the mirror member arranged closest to the optical disk member.

9. A method which uses a curing device according to claim 1 to cure paint-coated substrates.

10. The method according to claim 9, wherein UV intensity in the processing zone is increased by shortening a light path d from the radiation source to the paint-coated substrates.

11. The method according to claim 10, characterized in that the paint-coated substrates are cooled separately by means of cooling gas.

12. The method according to claim 9, characterized in that the paint-coated substrates are cooled separately by means of cooling gas.

* * * * *